US006405012B2

(12) United States Patent
Ishikawa

(10) Patent No.: US 6,405,012 B2
(45) Date of Patent: Jun. 11, 2002

(54) IMAGE FORMING APPARATUS AND PROCESS CARTRIDGE WITH COPY MEDIUM STATIC ELIMINATOR

(75) Inventor: Satoru Ishikawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/819,617

(22) Filed: Mar. 29, 2001

(30) Foreign Application Priority Data

Mar. 30, 2000 (JP) ..... 2000-095110

(51) Int. Cl.[7] ..... G03G 15/00
(52) U.S. Cl. ..... 399/315; 361/213; 361/214
(58) Field of Search ..... 399/315, 397, 399/398, 400; 361/213, 214, 220, 221

(56) References Cited

U.S. PATENT DOCUMENTS 5,710,692 A * 1/1998 Muck et al. ..... 361/212
5,740,006 A * 4/1998 Larkin ..... 361/213

FOREIGN PATENT DOCUMENTS

JP 57-179876 * 11/1982
JP 7-36287 * 2/1995

* cited by examiner

*Primary Examiner*—Joan Pendegrass
(74) *Attorney, Agent, or Firm*—Oliff & Berridge, PLC

(57) ABSTRACT

An image forming apparatus includes a photosensitive drum, a transfer roller and an antistatic sheet. The cylindrical surface of the photosensitive drum can be supplied with a developer. The transfer roller transfers the developer on the drum surface onto one side of a sheet of paper. The antistatic sheet is provided downstream from the transfer roller in the feed path to eliminate electric charge accumulated on the sheet of paper. The antistatic sheet includes a fibrous electric conductor and a non-fibrous electric conductor, which is connected electrically with the conductor, and which is positioned between the conductor and the other side of the sheet of paper passing over the antistatic sheet. The antistatic sheet can prevent the non-fibrous electric conductor from fluffing which causes print failure.

18 Claims, 4 Drawing Sheets

IMAGE FORMING APPARATUS AND PROCESS CARTRIDGE WITH COPY MEDIUM STATIC ELIMINATOR

BACKGROUND OF THE INVENTION

1. Field of the Invention

The present invention related to an image forming apparatus and a process cartridge in which it is possible to effectively eliminate electric charge on a transfer medium onto which a toner image formed on an electrostatic latent image carrier can be transferred.

2. Description of the Related Art

A conventional laser beam printer includes a photosensitive drum. An electrostatic latent image can be formed on the cylindrical surface of the photosensitive drum with a laser beam. A visible image can be elicited with toner supplied to the latent image. The visible image on the photosensitive drum can be transferred onto one side of a sheet of paper by the attractive force of the electric charge supplied to the other side of the sheet. After the visible image is transferred onto the sheet, the electric charge accumulated on the sheet may cause a paper jam and prevent the sheet from being fed smoothly.

In order to avoid paper jams and smooth the paper feeding, the conventional printer includes a static eliminator for moderately eliminating the electric charge accumulated on a sheet of paper. Such a static eliminator of the ordinary type needs to be grounded, and consequently its design and manufacturing process are complicated.

In recent years, fibrous electric conductors may be used as static eliminators, which do not need to be grounded. A fibrous electric conductor is very suitable as a static eliminator because it can effectively eliminate electric charge by repeating a minute amount of discharge from the ends of its intertwined conducting fibers (self-discharge effect).

However, static electricity fluffs the fibrous conductor. When the fluff touches that side of a sheet of paper where no image is formed, an excessive amount of electric charge accumulated on the sheet may be eliminated. The excessive elimination weakens the attractive force between the sheet and the toner transferred onto it. This disturbs or distorts the toner image formed on the sheet. If the fibrous conductor and the sheet are spaced from each other so that the fluff does not touch the sheet, it is not possible to eliminate a sufficient amount of electric charge accumulated on the sheet.

SUMMARY OF THE INVENTION

It is an object of the present invention to provide an image forming apparatus for stably feeding paper and for forming a high-quality image on the paper by effectively eliminating the electric charge accumulated on the paper after toner is transferred onto the paper. It is another object to provide a process cartridge for use in such an image forming apparatus.

In accordance with a first aspect of the present invention, an image forming apparatus is provided, which comprises a feed path, an electrostatic latent image carrier, a transferring unit and a static eliminator. A transfer medium can pass along the feed path. The latent image carrier can be supplied with a developer. The transferring unit transfers, onto one side of the transfer medium passing along the feed path, the developer supplied to the latent image carrier. The static eliminator is provided downstream from the transferring unit in the feed path, and eliminates electric charge accumulated on the passing medium. The static eliminator includes a fibrous electric conductor and a non-fibrous electric conductor, which are connected electrically with each other. The non-fibrous conductor is positioned between the fibrous conductor and the other side of the passing medium.

The non-fibrous conductor between the fibrous conductor and the transfer medium passing along the feed path prevents the surfaces of the fibrous conductor from fluffing, and enables the fibrous conductor to self-discharge. This makes it possible to simplify the design and production processes, smooth the paper feeding, and prevent the image quality from worsening.

The fibrous conductor may be an electrically conducting nonwoven fabric, which includes fine fibers for better self-discharge effect.

The fibrous conductor may include electrically conducting fibers having a diameter of 4.5 or less microns for full self-discharge effect. In order to further enhance the self-discharge effect, electronically conjugate polymers may be reactively formed on the conducting fibers.

The non-fibrous conductor may be a sheet lying along the fibrous conductor. Without spoiling the self-discharge effect of the fibrous conductor, this sheet prevents the fibrous conductor from fluffing, and conducts electric charge effectively to it.

The non-fibrous conductor may be a resin sheet with an aluminum film formed on it for higher conductivity, which results in more effective static elimination from the transfer medium.

The non-fibrous conductor may be positioned out of contact with the transfer medium passing along the feed path. This prevents excessive elimination of electric charge, which would occur if the transfer medium touched the static eliminator. The prevention results in stable static elimination.

In accordance with a second aspect of the present invention, a process cartridge is provided, which can be fitted to and removed from an image forming apparatus. The apparatus has a feed path formed therein along which a transfer medium can pass. The process cartridge includes a transferring unit for transferring developer onto one side of the passing transfer medium. The process cartridge includes an electrostatic latent image carrier contacting with the transferring unit. The process cartridge also includes a static eliminator for eliminating electric charge accumulated on the transfer medium. The static eliminator is provided downstream from the transferring unit in the feed path. The static eliminator includes a fibrous electric conductor and a non-fibrous electric conductor that are connected electrically with each other. The non-fibrous conductor is positioned between the fibrous conductor and the other side of the passing transfer medium.

BRIEF DESCRIPTION OF THE DRAWINGS

A preferred embodiment of the present invention will be described below in detail with reference to the accompanying drawings, in which.

DETAILED DESCRIPTION OF THE PREFERRED EMBODIMENT

Figure 1:
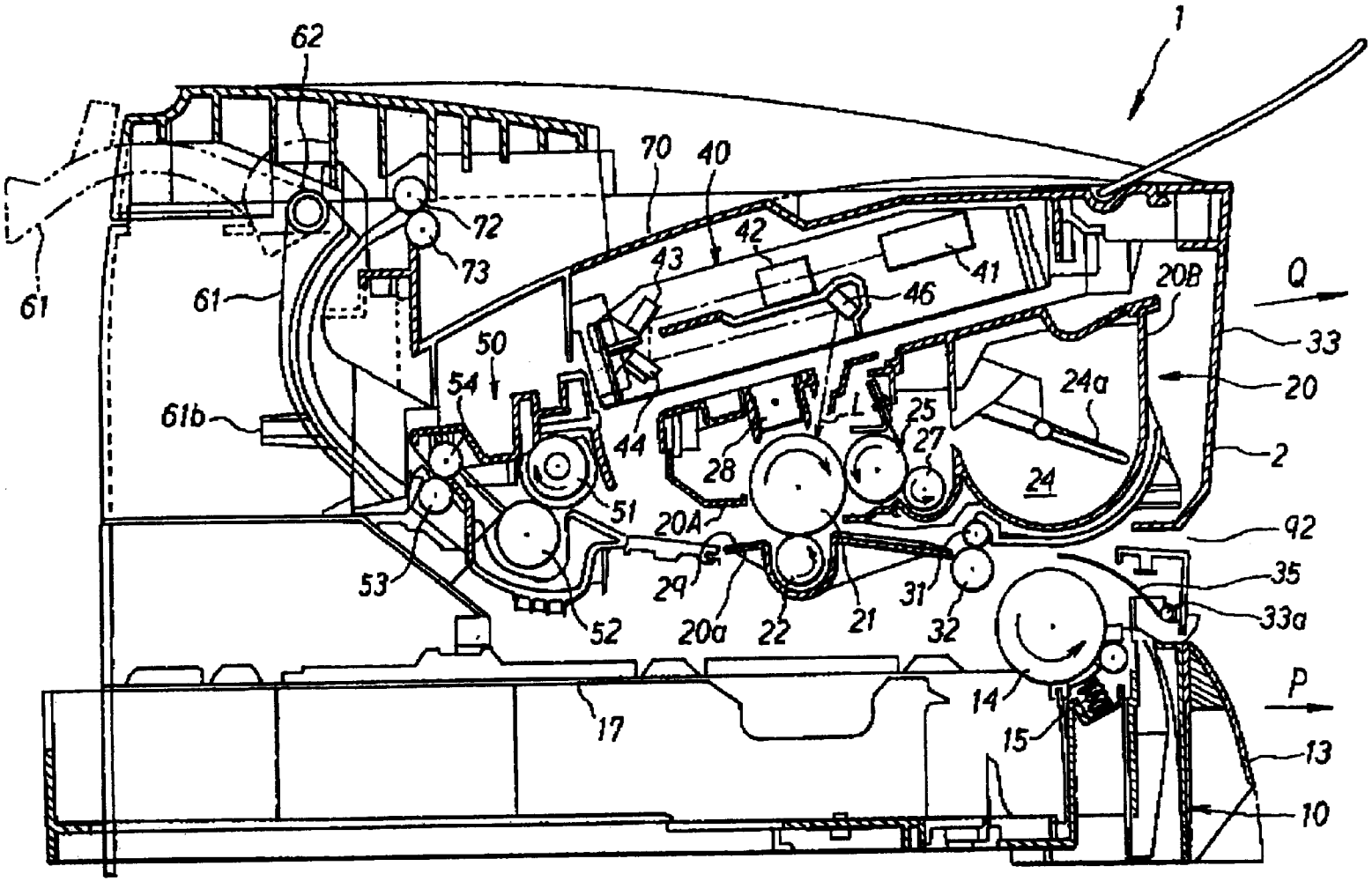
FIG. 1 is a vertical cross section of a laser beam printer embodying the invention.

As shown in FIG. 1, a laser beam printer 1 includes a casing and a feed cassette 10, which is fitted removably in the bottom of the casing. The printer casing supports a feed roller 14 in it, which can rotate counter-clockwise in FIG. 1. The feed cassette 10 includes a handle 13, which can be pulled in a direction p to remove the feed cassette 10. The feed cassette 10 houses a pressure plate (not shown), on which sheets of paper can be stacked. The pressure plate is urged upward by a compression spring (not shown) to bring the top sheet of paper into contact with the cylindrical surface of the feed roller 14. A separating pad 15 cooperates with the rotating feed roller 14 to separate the top sheet on the pressure plate.

Figure 2:
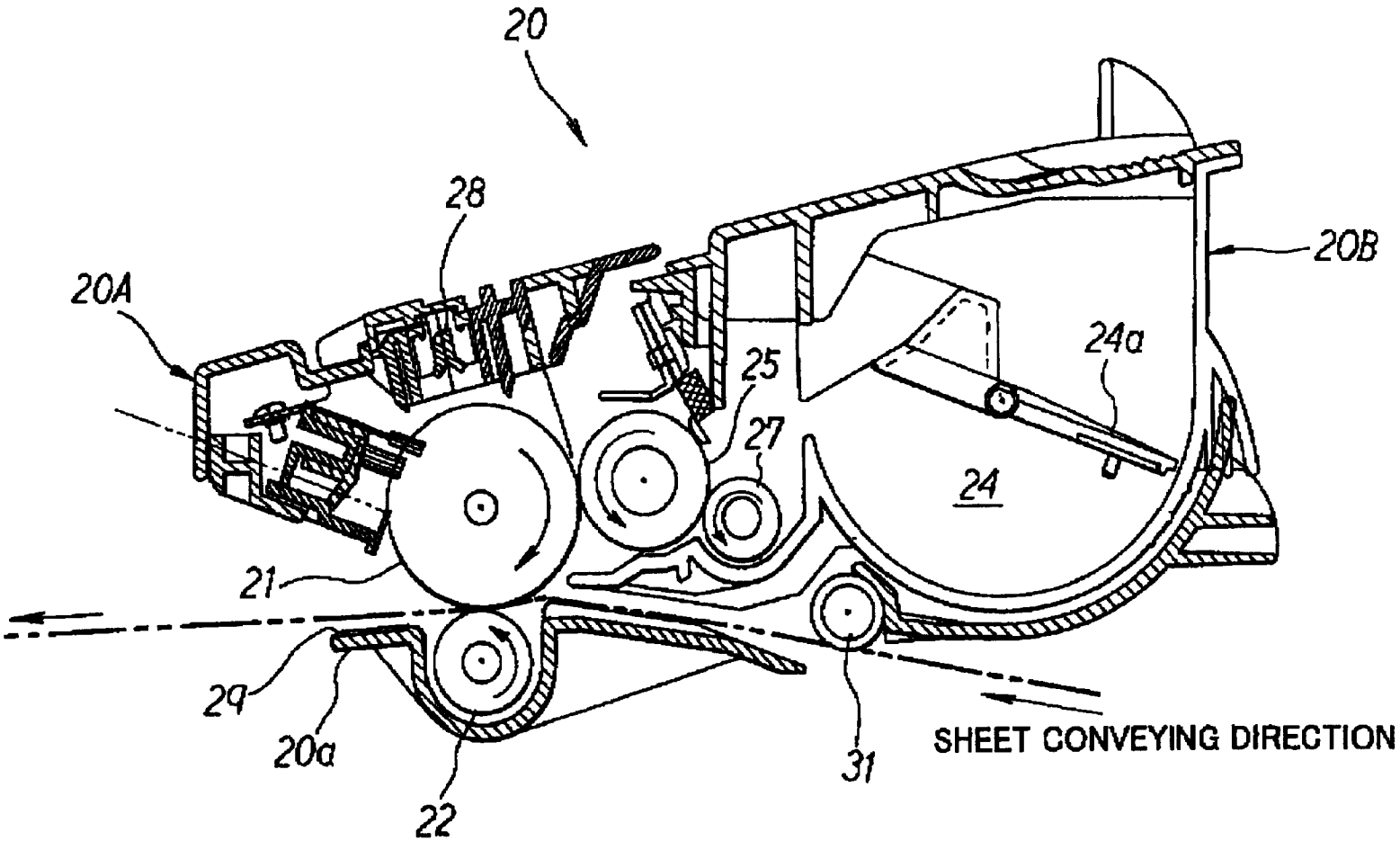
FIG. 2 is a vertical cross section of the process cartridge of the printer.

A process cartridge 20 is fitted removably over the feed cassette 10 and can, for toner replacement, be pulled out in a direction Q. As shown in FIGS. 1 and 2, the process cartridge 20 consists of a photoreceptor cartridge 20A and a developing cartridge 20B.

The photoreceptor cartridge 20A includes a photosensitive drum 21, a transfer roller 22 and a scorotron type charger 28. A sheet of paper comes into contact with the cylindrical surface of the photosensitive drum 21 so that toner is transferred from the drum surface onto the sheet. The cylindrical surfaces of the photosensitive drum 21 and transfer roller 22 are in contact with each other. The scorotron type charger 28 discharges a corona to charge the surface of the photosensitive drum 21 so that the drum surface has a positive potential.

The developing cartridge 20B includes a developer chamber 24, a supply roller 27 and a developing roller 25. The developer chamber 24 contains toner and houses an agitator 24*a* for agitating the toner. The supply roller 27 supplies toner to the developing roller 25, which supplies toner to the photosensitive drum 21.

Figure 3:
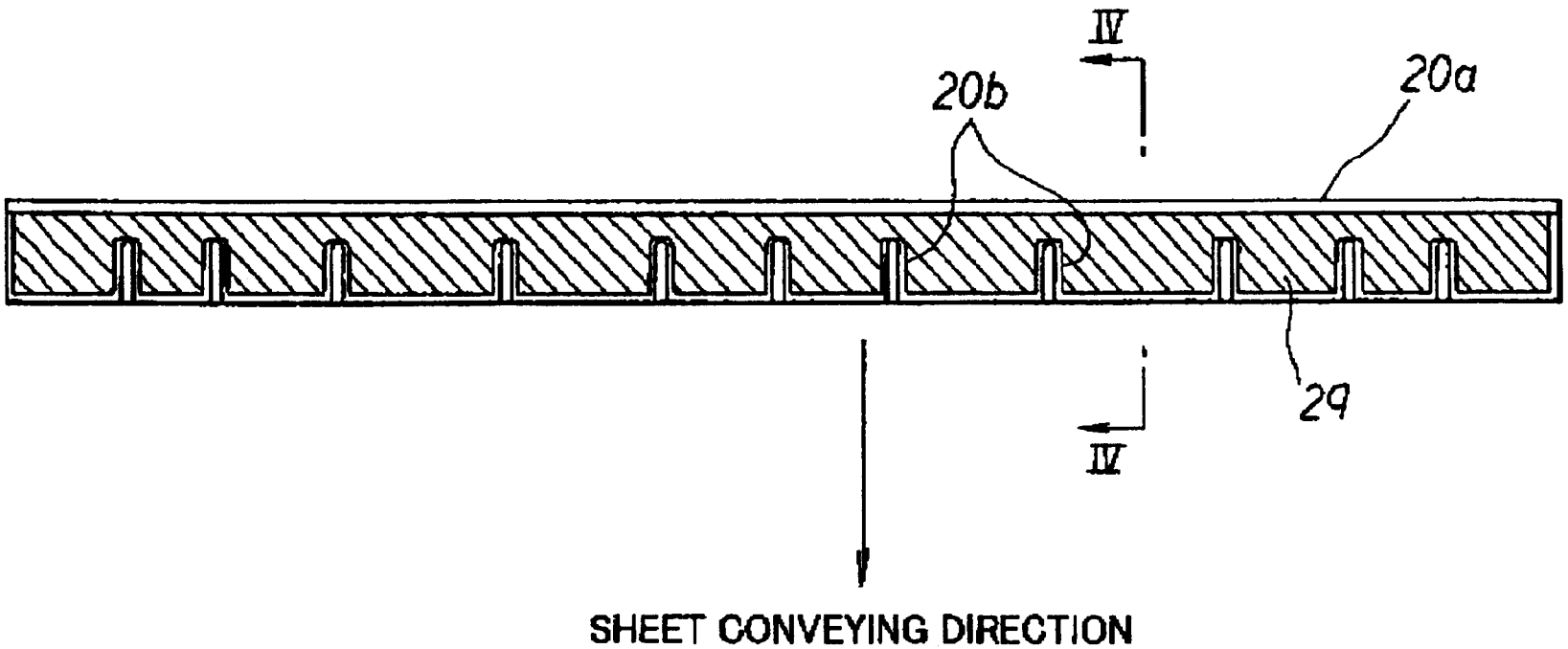
FIG. 3 is a top plan of the antistatic sheet of the process cartridge.

The photoreceptor cartridge 20A includes a casing 20*a*, which is fitted with an antistatic sheet 29 near the transfer roller 22. The antistatic sheet 29 is fixed to the casing 20*a* with a tape having pressure-sensitive adhesive coated on the both sides thereof. As shown in FIG. 3, the antistatic sheet 29 is rectangular and extends across the feed path of the laser beam printer 1. The antistatic sheet 29 has eleven notches (only two notches are designated by numerals in FIG. 3) 20*b*, which engage with the ribs (not shown) formed on the casing 20*a*. The antistatic sheet 29 can be mounted on the casing 20*a* in the paper feeding direction (sheet conveying direction).

Figure 4:
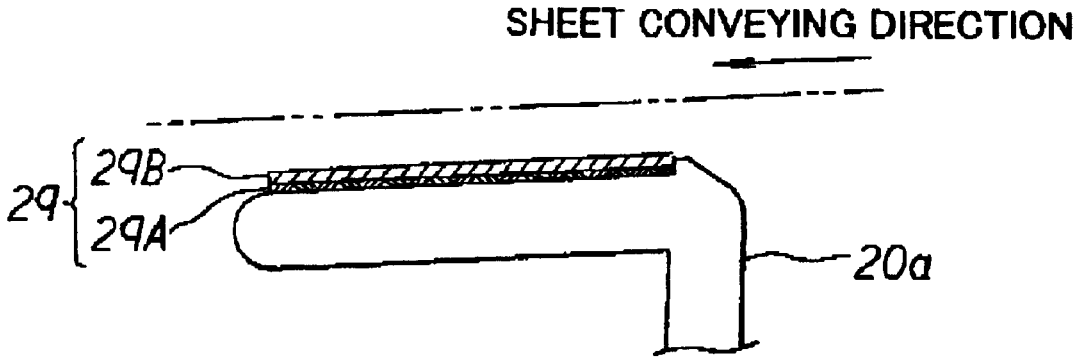
FIG. 4 is a cross section taken along line IV—IV of FIG. 3.

As shown in FIG. 4, the antistatic sheet 29 includes a fibrous electric conductor 29A and another electric conductor 29B, which lie on its inner and outer sides, respectively. The conductors 29A and 29B are bonded together by pressure-sensitive adhesive double-coated tape or the like.

The fibrous conductor 29A may be a nonwoven fabric including very thin fibers on which a polymer having electronically conjugated system is reactively formed. The nonwoven fabric may be DENKITOL VLS6209F, which is the trade name of a product of Japan vilene Company, Limited. This product includes very thin fibers formed by cutting a conductive fiber having a diameter of 4.5 microns ($\mu$m) such as to divide to a plurality of pieces in symmetrical with respect to the center of the conductive fiber in the cross section. A minute amount of discharge from the ends of the fine fibers can be repeated for sufficient static elimination.

The electric conductor 29B may be a PET (polyethylene terephthalate) film with aluminum films or other metal films vapor-deposited on both its sides. The electric conductor 29B may be formed of a wide variety of other material, which can be a conductor as a whole. For example, the conductor 29B may be metal plates, metal foil, conductive polyester film, conductive plastic film and conductive rubber sheets.

The photoreceptor cartridge 20A and developing cartridge 20B can be disassembled from each other. When the process cartridge 20 is dismounted from the printer casing 2, the two cartridges 20A and 20B are assembled. As shown in FIG. 1, the printer 1 includes a front cover 33 supported at its bottom pivotally on a pivotal shaft 33*a*. With the front cover 33 turned clockwise in FIG. 1 so that the front of the printer 1 opens, the process cartridge 20 can be mounted and dismounted.

Supported rotatably between the process cartridge 20 and the feed cassette 10 are a pair of registration rollers 31 and 32.

Fitted over the process cartridge 20 is a laser scanner unit 40, which includes a laser beam emitter (not shown), a polygonal mirror 41, a lens 42, reflective mirrors 43 and 44, a lens 45 and a reflective mirror 46. The polygonal mirror 41 can be rotated and reflect laser beams L, which pass through the lens 42, reflectors 43 and 44, lens 45 and reflector 46, and are then radiated onto the cylindrical surface of the photosensitive drum 21 to form an electrostatic latent image on it.

Provided in back of the process cartridge 20 is a fixing unit 50 for fixing toner on a sheet of paper. The fixing unit 50 includes a heating roller 51, a pressing roller 52, and a pair of conveying rollers 53 and 54. The cylindrical surfaces of the heating roller 51 and pressing roller 52 are in compressive contact with each other. The heating roller 51 heats and melts the toner transferred onto the sheet. The pressing roller 52 presses the sheet against the heating roller 51.

In back of the conveying rollers 53 and 54, a shooter 61 is supported pivotally on a pivot shaft 62. As the need arises, the shooter 61 reverses the paper conveying direction. In front of the pivot shaft 62, a pair of discharge rollers 72 and 73 are supported. On the upper side of the printer 1, a discharge tray 70 is formed. The discharge rollers 72 and 73 support a sheet of paper conveyed along the shooter 61, and discharge it to the discharge tray 70.

The rotation of the feed roller 14 at predetermined timing feeds sheets of paper one after one from the feed cassette 10. A guide 35 reverses the paper feeding direction. The registration rollers 31 and 32 register, or position the front end of a sheet of paper from the guide 35. Subsequently, the sheet is fed to the nip between the photosensitive drum 21 and transfer roller 22.

The cylindrical surface of the photosensitive drum 21 is charged by the charger 28. The laser scanner unit 40 emits laser beams, which are radiated onto the charged surface of the photosensitive drum 21 so that an electrostatic latent image is formed on this drum surface. When the latent image comes into contact with the cylindrical surface of the developing roller 25, this image is elicited by the toner supplied via the supply roller 27 and the developing roller 25. The elicited toner image is then transferred onto the sheet passing between the photosensitive drum 21 and transfer roller 22.

The sheet of paper with the toner image transferred onto it passes over the antistatic sheet 29, without touching the electric conductor 29B. When the sheet of paper passes over the antistatic sheet 29, the electric charge accumulated on its non-printed side is eliminated stably through the antistatic sheet 29. This prevents paper jams due to charge accumulation.

The sheet of paper from the antistatic sheet 29 passes between the heating roller 51 and the pressing roller 52. When the sheet of paper passes between the rollers 51 and 52, heat and pressure are applied to it to fix the toner image onto it.

The sheet with the toner image fixed onto it passes between the conveying rollers 53 and 54, and is then conveyed along the shooter 61. The conveyed sheet passes between the discharge rollers 72 and 73, and is then discharged with its printed side down (face down) onto the discharge tray 70. If the shooter 61 is thrown (drawn) up to the backside of the printer 1, the sheet is discharged with its printed side up (face up) to the backside of the printer.

Figure 5:
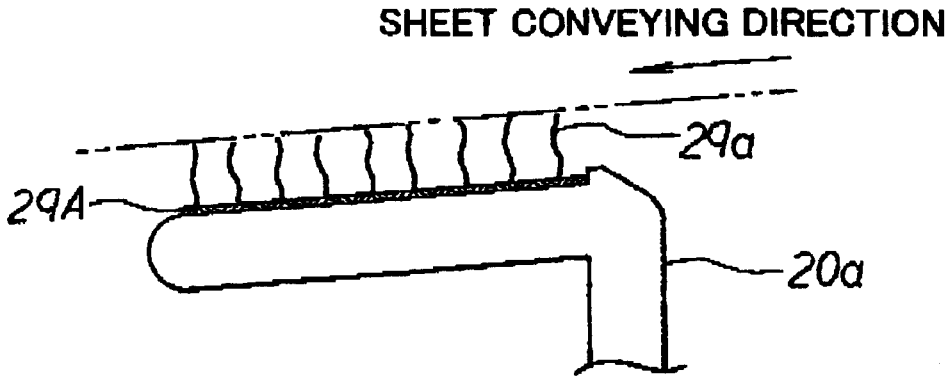
FIG. 5 is a fragmentary cross section showing a fibrous electric conductor used alone in place of the antistatic sheet.

The inventor made an experiment on the static elimination from a sheet of paper, as shown in FIG. 5, where a fibrous conductor 29A was used alone in place of the antistatic sheet 29. Electrostatic force produced fluff 29*a* on the fibrous conductor 29A. It was found out that an excessive amount of electric charge accumulated on the sheet of paper was eliminated through the fluff 29*a* in direct contact with the sheet, with the result that the amount of electric charge on the sheet was unstable and consequently print failure occurred. It is conceivable that such sudden static elimination produced an electric current on the sheet of paper, with the result that the current affected the amount of electric charge on that area of the sheet which is near to the photosensitive drum 21 and transfer roller 22.

In the embodiment, as shown in FIG. 4, the electric conductor 29B lies on the fibrous electric conductor 29A so as to prevent the fibrous conductor 29A from fluffing. If fluff were produced from the fibrous conductor 29A, a sheet of paper could come into direct contact with the antistatic sheet 29 through the fluff. This makes it possible to stably eliminate electric charge from the sheet of paper through the conductor 29B toward the fibrous conductor 29A, preventing print failure.

The antistatic sheet 29 lies on the casing 20*a* of the process cartridge 20, but might alternatively be fitted to the frame of the laser beam printer 1 with a similar effect.

What is claimed is:

1. An image forming apparatus for forming an image on a medium, comprising:

a feed path along which a medium passes;

an electrostatic latent image carrier which an electrostatic latent image is formed and onto which a developer is supplied;

a transferring unit for transferring the supplied developer onto one side of the passing medium;

a static eliminator for eliminating electric charge accumulated on the medium, the static eliminator being provided downstream from the transferring unit in the feed path;

the static eliminator including a fibrous electric conductor and a non-fibrous electric conductor connected electrically with the fibrous electric conductor, the non-fibrous conductor being positioned between the fibrous conductor and the other side of the passing medium.

2. The image forming apparatus according to claim 1, wherein the fibrous conductor is an electrically conducting nonwoven fabric.

3. The image forming apparatus according to claim 1, wherein the fibrous conductor includes electrically conducting fibers having a diameter of 4.5 or less microns.

4. The image forming apparatus according to claim 1, wherein a polymer having electronically conjugated system is reactively formed on the conducting fibers.

5. The image forming apparatus according to claim 1, wherein the non-fibrous conductor is a sheet formed on the fibrous conductor.

6. The image forming apparatus according to claim 5, wherein the non-fibrous conductor is a resin sheet on which an aluminum film is formed.

7. The image forming apparatus according to claim 1, wherein the non-fibrous conductor is positioned out of contact with the medium passing along the feed path.

8. The image forming apparatus according to claim 1, further comprising a process cartridge which is removably fitted to the image forming apparatus and accommodates the electrostatic latent image carrier and the transferring unit, wherein the static eliminator is provided on a casing of the process cartridge.

9. The image forming apparatus according to claim 1, the non-fibrous conductor is extended in a direction perpendicular to a direction of the feed path.

10. A process cartridge which is removably fitted to an image forming apparatus having a feed path formed therein along which a medium passes, the process cartridge comprising:

an electrostatic latent image carrier which an electrostatic latent image is formed and onto which a developer is supplied;

a transferring unit for transferring the supplied developer onto one side of the passing medium;

a static eliminator for eliminating electric charge accumulated on the medium, the static eliminator being provided downstream from the transferring unit in the feed path;

the static eliminator including a fibrous electric conductor and a non-fibrous electric conductor connected electrically with the fibrous electric conductor, the non-fibrous conductor being positioned between the fibrous conductor and the other side of the passing medium.

11. The process cartridge according to claim 10, wherein the fibrous conductor is an electrically conducting nonwoven fabric.

12. The process cartridge according to claim 10, wherein the fibrous conductor includes electrically conducting fibers having a diameter of 4.5 or less microns.

13. The process cartridge according to claim 10, wherein a polymer having electronically conjugated system is reactively formed on the conducting fibers.

14. The process cartridge according to claim 10, wherein the non-fibrous conductor is a sheet formed on the fibrous conductor.

15. The process cartridge according to claim 14, wherein the non-fibrous conductor is a resin sheet on which an aluminum film is formed.

16. The process cartridge according to claim 10, wherein the non-fibrous conductor is positioned out of contact with the medium passing along the feed path.

17. The process cartridge according to claim 10, further comprising a casing of the process cartridge wherein the static eliminator is provided on the casing.

18. The process cartridge according to claim 10, the non-fibrous conductor is extended in a direction perpendicular to a direction of the feed path.

* * * * *